US007866194B2

(12) United States Patent
Liu

(10) Patent No.: US 7,866,194 B2
(45) Date of Patent: Jan. 11, 2011

(54) UNLOCKING DEVICE FOR CONCEALING KEYHOLE OF LOCK

(76) Inventor: Shih-Te Liu, No. 13, Aly. 8, Ln. 14, Shanggang St., Qijin Dist., Kaohsiung (TW)

( * ) Notice: Subject to any disclaimer, the term of this patent is extended or adjusted under 35 U.S.C. 154(b) by 0 days.

(21) Appl. No.: 12/565,975

(22) Filed: Sep. 24, 2009

(65) Prior Publication Data

US 2010/0077812 A1 Apr. 1, 2010

(30) Foreign Application Priority Data

Oct. 1, 2008 (TW) ..... 97217617 U

(51) Int. Cl.
*E05B 19/00* (2006.01)
*E05B 15/08* (2006.01)
*E05B 17/14* (2006.01)

(52) U.S. Cl. ..... 70/395; 70/408; 70/423; 70/427; 70/454; 70/455

(58) Field of Classification Search ..... 70/395, 70/408, DIG. 38, 423–428, 453–455
See application file for complete search history.

(56) References Cited

U.S. PATENT DOCUMENTS 249,124 A * 11/1881 Voos ..... 70/428
3,630,053 A * 12/1971 Krakauer ..... 70/51
3,714,804 A * 2/1973 French ..... 70/419
3,765,199 A * 10/1973 Wiczer ..... 70/423
3,834,198 A * 9/1974 Wiczer ..... 70/208
5,077,996 A 1/1992 Lien
5,329,792 A 7/1994 Lee
6,494,064 B1 12/2002 Pena
6,610,947 B2 * 8/2003 Campana et al. ..... 200/336
2007/0157687 A1 * 7/2007 Bull et al. ..... 70/454

FOREIGN PATENT DOCUMENTS

TW M287361 2/2006

* cited by examiner

*Primary Examiner*—Lloyd A Gall
(74) *Attorney, Agent, or Firm*—Alan Kamrath; Kamrath & Associates PA

(57) ABSTRACT

An unlocking device includes a casing mounted to a side of a lock having a keyhole. A movable body is rotatably received in the casing about an axis. The movable body has a closed end having a hole. A key receiving seat is received in the movable body and has a key receiving hole. The keyhole is normally blocked by the closed end of the movable body. The movable body can be rotated to align the hole with the keyhole and the key receiving hole. A block is fixed to the movable body and includes a through-hole extending along the axis. A manually rotatable linking rod extends through the through-hole and has an engaging portion for coupling a key received in the key receiving hole. The key can be moved into the keyhole by moving the linking rod along the axis and can be rotated for locking or unlocking operation.

11 Claims, 3 Drawing Sheets

UNLOCKING DEVICE FOR CONCEALING KEYHOLE OF LOCK

BACKGROUND OF THE INVENTION

1. Field of the Invention

The present invention relates to an unlocking device and, more particularly, to an unlocking device that conceals a keyhole of a lock and that can receive and guide a key into the keyhole for locking and unlocking operations.

2. Description of the Related Art

Conventional locks include one or more lock cores that can be rotated for locking or unlocking purposes. The keyholes of the lock cores are generally exposed for receiving keys. However, the locks are liable to be picked through the exposed keyholes. Furthermore, the keys could be copied by probing the shapes of the exposed keyholes.

Taiwan Utility Model No. M287361 entitled "SAFETY LOCK WITH CONCEALED KEYHOLE" discloses a lock including a body receiving a lock core. An escutcheon is mounted to an outer side of the body and has an opening aligned with a keyhole of the lock core. A magnetic board is mounted inside the escutcheon and includes a through-hole aligned with the opening and having a diameter slightly smaller than the opening. A decorative cover can be retained in the opening by magnetic attraction to conceal the keyhole. However, the decorative cover can be easily removed by a magnet having larger magnetic attraction than the magnetic board or by picking the decorative cover through a gap between the decorative cover and an inner periphery of the opening.

SUMMARY OF THE INVENTION

The primary objective of the present invention is to provide an unlocking device for concealing a keyhole of a lock, preventing the keyhole from being seen and preventing direct access to the keyhole.

Another objective of the present invention is to provide an unlocking device that can guide a key into the keyhole of the lock for locking or unlocking purposes.

A further objective of the present invention is to provide an unlocking device for concealing the keyhole of the lock for providing enhanced burglarproof effect.

The present invention fulfills the above objectives by providing, in a preferred form, an unlocking device including a casing adapted to be mounted to a side of a lock having a keyhole. The casing includes a compartment extending along an axis and having first and second openings spaced along the axis. The keyhole is located in an extent of the first opening. A movable body is rotatably received in the compartment of the casing about the axis. The movable body includes a closed end and an open end spaced from the closed end along the axis. A space is defined between the closed end and the open end. The space has an insertion hole in the open end. The closed end has a hole aligned with the keyhole of the lock. A key receiving seat is received in the space of the movable body. The movable body is rotatable relative to the key receiving seat between a first position and a second position. The key receiving seat includes a key receiving hole. A key is slideably received in the key receiving hole along the axis. The hole of the movable body, the key receiving hole of the key receiving seat, and the keyhole of the lock align with and face one another when the movable body is in the first position. The keyhole of the lock is blocked by the closed end of the movable body when the movable body is in the second position. A block fixed to the open end of the movable body.

The block includes first and second sides spaced along the axis. A through-hole extending from the first side through the second side of the block and has a receiving section. A linking rod extends through the through-hole of the block. The linking rod includes first and second end spaced along the axis. The first end of the linking rod is manually rotatable. The second end of the linking rod has an engaging portion engageable with the key. The key and the linking rod are jointly movable along the axis and jointly rotatable about the axis when the engaging portion of the linking rod is engaged with the key.

The present invention will become clearer in light of the following detailed description of illustrative embodiments of this invention described in connection with the drawings.

BRIEF DESCRIPTION OF THE DRAWINGS

The illustrative embodiments may best be described by reference to the accompanying drawings where.

Figure 1:
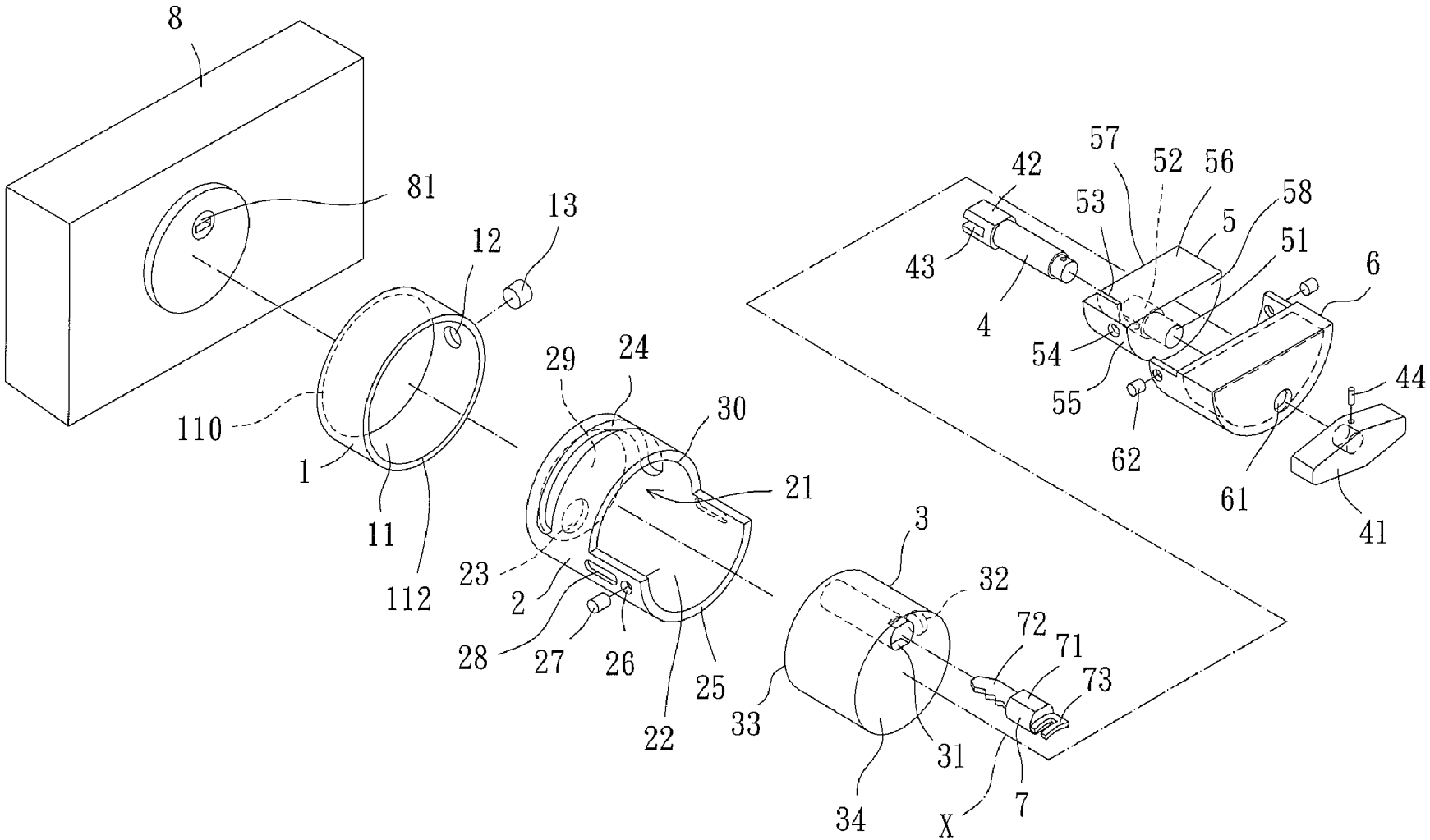
FIG. 1 shows an exploded, perspective view of an unlocking device according to the preferred teachings of the present invention.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "inner", "outer", "end", "portion", "section", "radial", "circumferential", "annular", "outward", "spacing", "width", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

An unlocking device according to the preferred teachings of the present invention is shown in the drawings. According to the preferred form shown, the unlocking device includes a casing 1, a movable body 2, a key receiving seat 3, a linking rod 4, and a block 5.

According to the preferred form shown, the casing 1 is adapted to be mounted to a side of a lock 8 having a keyhole 81. The casing 1 includes a compartment 11 extending along an axis X and having first and second openings 110 and 112 spaced along the axis X. The keyhole 81 is located in an extent of the first opening 110. In the most preferred form shown, the casing 1 includes a radial through-hole 12 formed in a peripheral wall thereof and in communication with the compartment 11.

According to the preferred form shown, the movable body 2 is rotatably received in the compartment 11 of the casing 1 about the axis X. The movable body 2 in the most preferred form shown is a hollow, cylindrical member and includes a closed end 29 and an open end 30 spaced from the closed end 29 along the axis X. A space 21 is defined between the closed end 29 and the open end 30. The space 21 has an insertion hole 22 in the open end 30, and the closed end 29 has a hole 23. The hole 23 of the movable body 2 is eccentric to a central axis of the insertion hole 22 (the axis X in the preferred form shown). A spacing from the axis X to the center of the hole 23 in a radial direction perpendicular to the axis X is larger than a radius of the hole 23. Furthermore, the movable body 2 includes a peripheral groove 24 formed in a peripheral wall of the movable body 2 extending between the closed end 29 and the open end 30 and in communication with the space 21. The peripheral groove 24 extends in a circumferential direction about the axis X. The movable body 2 further includes a skirt 25 extending outward from an end face of the open end 30 along the axis X. In the most preferred form shown, the skirt 25 extends through a half of a circumference of the insertion space 22. Furthermore, two slots 28 are defined in the skirt 25 and extend along the axis X. Further, the skirt 25 further includes a radial positioning hole 26.

According to the preferred form shown, the key receiving seat 3 is received in the space 21 of the movable body 2. The movable body 2 is rotatable relative to the key receiving seat 3 between a first position and a second position. The key receiving seat 3 in the most preferred form shown is a cylinder and includes first and second sides 33 and 34 spaced along the axis X and a key receiving hole 31 extending from the first side 33 through the second side 34 along the axis X. An end of the key receiving hole 31 of the key receiving seat 3 has non-circular cross sections. A radial coupling hole 32 is formed in a peripheral wall of the key receiving seat 3 and is aligned with the radial through-hole 12 of the casing 1. The casing 1 and the key receiving seat 3 are fixed together by a positioning member 13 extending from the radial through-hole 12 through the peripheral groove 24 of the movable body 2 into the radial coupling hole 32. The peripheral groove 24 has a width slightly larger than and slideably receives the positioning member 13, limiting angular movement of the movable body 2 about the axis X relative to the casing 1 and the key receiving seat 3.

According to the preferred form shown, the block 5 is fixed to the skirt 25 at the open end 30 of the movable body 2. The block 5 in the most preferred form shown includes semicircular cross sections corresponding to the skirt 25 and includes first and second sides 57 and 58 spaced along the axis X, a planar third side 56 extending between the first and second sides 57 and 58, and an arcuate wall 55. A through-hole 51 extends from the first side 57 through the second side 58 of the block 5 and has an enlarged receiving section 52 having a diameter larger than the through-hole 51. The through-hole 51 including the receiving section 52 of the block 5 is coaxial to the hole 23 of the movable body 2. An arcuate side groove 53 extends from the third side 56 through an inner periphery of the receiving section 52 of the block 5. In the most preferred form shown, the arcuate wall 55 of the block 5 has a positioning hole 54. A fastener 27 is extended through the positioning hole 26 of the movable body 2 into the positioning hole 54 of the block 5, fixing the block 5 and the movable body 2 together.

According to the preferred form shown, the linking rod 4 extends through the through-hole 51 of the block 5. The linking rod 4 includes first and second end spaced along the axis X. A knob 41 is fixed by a fastener 44 such as a pin or screw to the first end of the linking rod 4. The second end of the linking rod 4 has an engaging portion 42. The engaging portion 42 of the linking rod 4 is received in the receiving section 52 of the block 5 and has a maximum diameter larger than a diameter of the through-hole 51 of the block 5. In the most preferred form shown, the engaging portion 42 of the linking rod 4 includes an engaging groove 43 in communication and aligned with the side groove 53 of the block 5 when the engaging portion 42 is received in the receiving section 52. Furthermore, the engaging portion 42 has non-circular cross sections corresponding to the end of the key receiving hole 31. The key receiving hole 31 of the key receiving seat 3 has a diameter larger than a maximum radius of the engaging portion 42 of the linking rod 4.

According to the preferred form shown, a key 7 includes an end having a toothed portion 72 insertable into the keyhole 81 of the lock 8. A coupling portion 73 is formed on the other end of the key 7. The key 7 further includes an insertion portion 71 intermediate the toothed portion 72 and the coupling portion 73 and having cross sections corresponding to the non-circular cross sections of the end of the key receiving hole 31. Namely, the key 7 can be inserted into the key receiving hole 31 in a certain orientation. In the most preferred form shown, the side groove 53 of the block 5, the engaging groove 43 of the linking rod 4, and the coupling portion 73 of the key 7 are arcuate and have the same radius of curvature.

According to the most preferred form shown, an outer cover 6 is fixed around the block 5 and the skirt 25. The outer cover 6 includes a hole 61 aligned with the through-hole 51 of the block 5. The knob 41 is fixed to the end of the linking rod 4 extending beyond the hole 61 of the outer cover 6. The outer cover 6 moves jointly with the linking rod 4 by a pin or tight fitting. Furthermore, the outer cover 6 includes two positioning holes. A limiting member 62 such as a pin is extended through each slot 28 of the skirt 25 and one of the positioning holes of the outer cover 6, such that the outer cover 6 can move relative to the movable body 2 and the block 5 along the axis X.

In use, the unlocking device according to the preferred teachings of the present invention is mounted to the side of the lock 8 with the key receiving hole 31 of the key receiving seat 3 aligned with the keyhole 81. The unlocking device according to the preferred teachings of the present invention can be mounted to the side of the lock 8 by any suitable provisions. As an example, the casing 1 can include a fixing portion that can be screwed to the side of the lock 8. In another example, an additional fixing seat can be provided to fix the unlocking device in place. The unlocking device according to the preferred teachings of the present invention can be utilized with various locks including locks for boxes, door locks, U-shaped locks, and vehicle locks.

Figure 2:
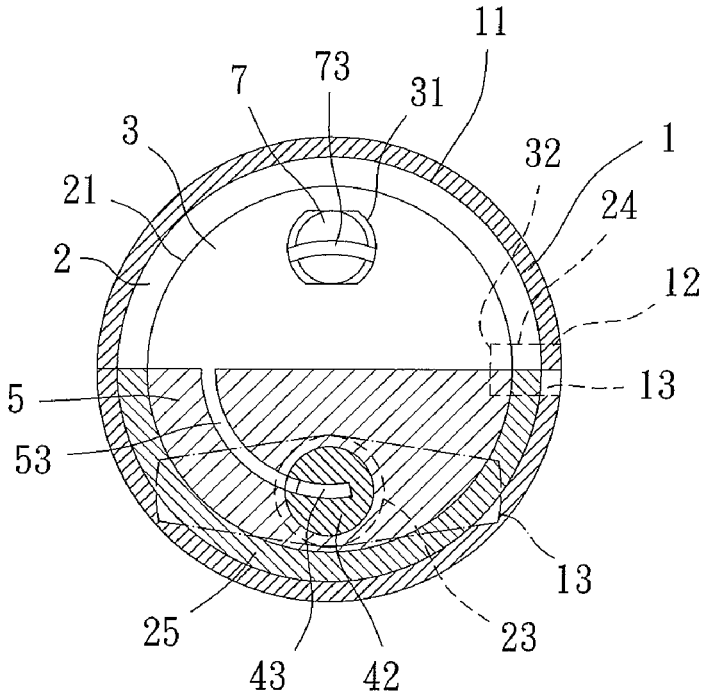
FIG. 2 shows a cross sectional view of the unlocking device of FIG. 1 with a key inserted into the unlocking device.
Figure 3:
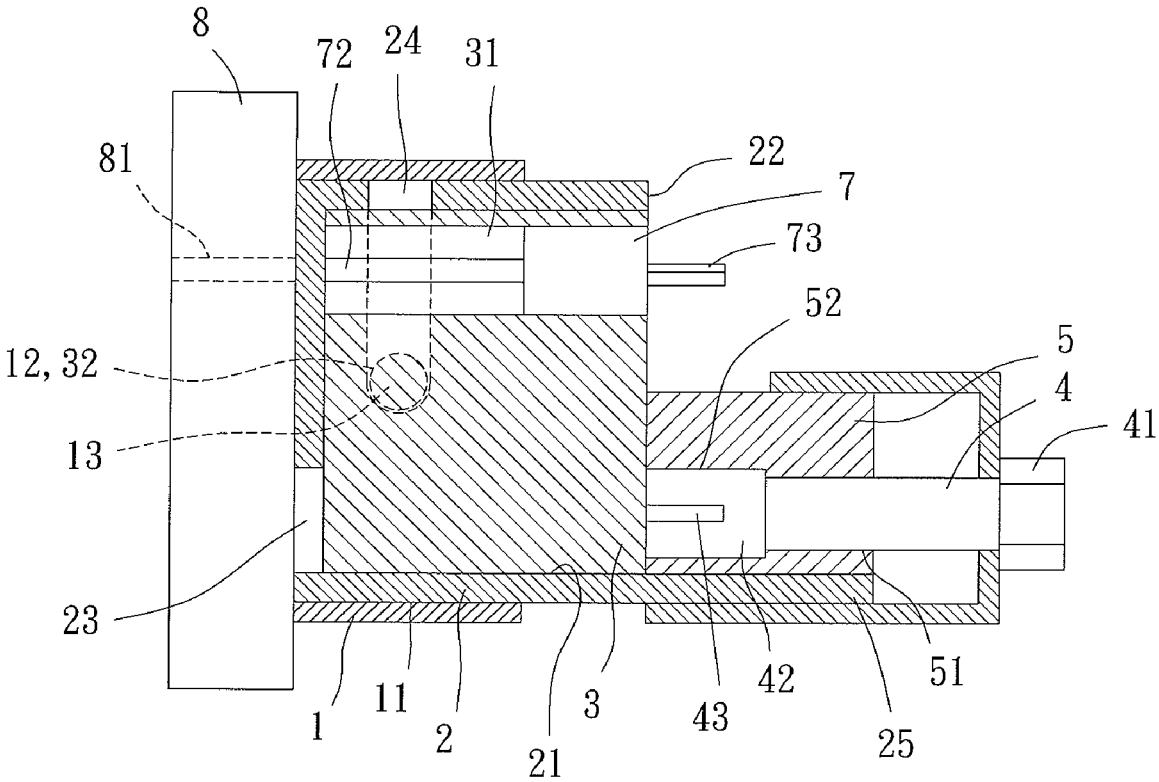
FIG. 3 shows another cross sectional view of the unlocking device of FIG. 1 with a key inserted into the unlocking device.

In operation, the key 7 is inserted into the key receiving hole 31 of the key receiving seat 3. Since, the insertion portion 71 of the key 7 and the end of the key receiving hole 31 have non-circular cross sections, the key 7 can only be inserted into the key receiving hole 31 in a certain orientation, as mentioned above. The movably body 2 is in the second position relative to the key receiving seat 3. Specifically, the keyhole 81 of the lock 8 is blocked by the closed end 29 of the movable body 2, and the hole 23 of the movable body 2 is not aligned with the keyhole 81 and the key receiving hole 31 (FIGS. 1-3).

Figure 4:
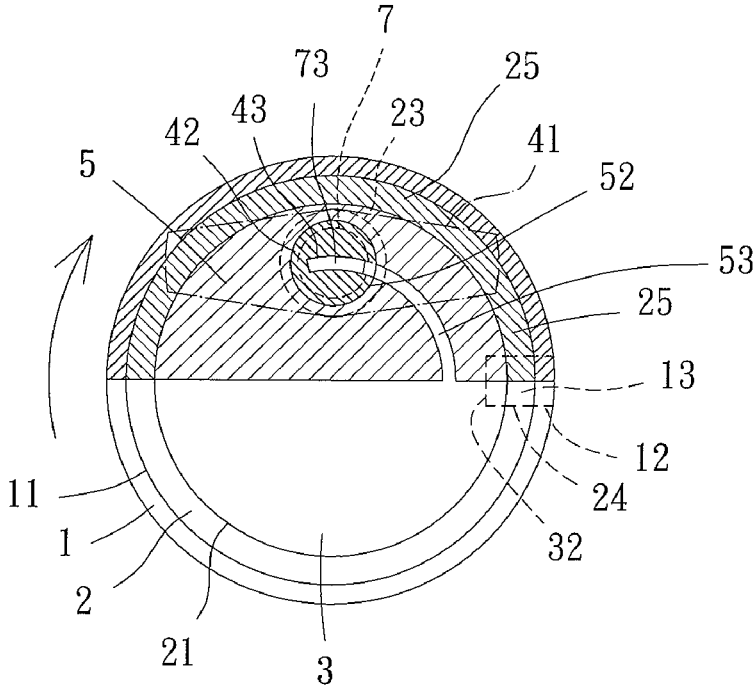
FIG. 4 is a cross sectional view similar to FIG. 2, illustrating locking or unlocking operation.
Figure 5:
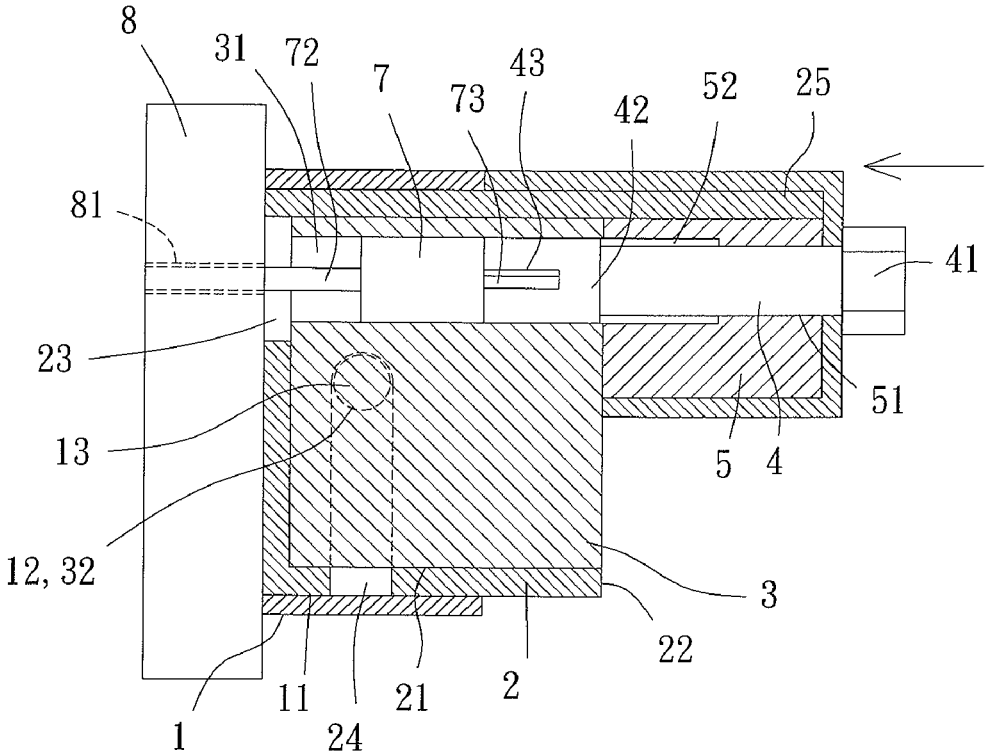
FIG. 5 is a cross sectional view similar to FIG. 3, illustrating locking or unlocking operation.

The movable body 2 is then moved to the first position such that the hole 23 of the movable body 2, the keyhole 81, and the key receiving hole 31 face and align with one another. At the same time, the block 5 rotates together with the movable body 2, such that the side groove 53 of the block 5 moves to a position engaged with the coupling portion 73 of the key 7. In this case, the engaging portion 42 of the linking rod 4 also engages with the coupling portion 73 of the key 7 (FIGS. 4 and 5). Specifically, the coupling portion 73 of the key 7 passes through the side groove 53 of the block 5 into the engaging groove 43 of the linking rod 4 when the movable body 2 is moved to the first position. This is because the side groove 53 of the block 5, the engaging groove 43 of the linking rod 4, and the coupling portion 73 of the key 7 have the same radius of curvature.

Then, the linking rod 4 is pushed at the knob 41 to move toward the casing 1 along the axis X, so that the toothed portion 72 of the key 7 moves through the hole 23 of the movable body 2 into the keyhole 81 of the lock 8. Next, the knob 41 of the linking rod 4 is rotated for locking or unlocking operation.

According to the above, the unlocking device according to the preferred teachings of the present invention can guide the key 7 into the keyhole 81 of the lock 8 as well as conceal the keyhole 81 to prevent direct access to the keyhole 81.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. An unlocking device comprising:

a casing adapted to be mounted to a side of a lock having a keyhole, with the casing including a compartment extending along an axis and having first and second openings spaced along the axis, with the keyhole located in an extent of the first opening;

a movable body rotatably received in the compartment of the casing about the axis, with the movable body including a closed end and an open end spaced from the closed end along the axis, with a space defined between the closed end and the open end, with the space having an insertion hole in the open end, with the closed end having a hole aligned with the keyhole of the lock;

a key receiving seat received in the space of the movable body, with the movable body rotatable relative to the key receiving seat between a first position and a second position, with the key receiving seat including a key receiving hole, with a key slideably received in the key receiving hole, with the hole of the movable body, the key receiving hole of the key receiving seat, and the keyhole of the lock aligned with and facing one another when the movable body is in the first position, with the keyhole of the lock being blocked by the closed end of the movable body when the movable body is in the second position;

a block fixed to the open end of the movable body, with the block including first and second sides spaced along the axis, with a through-hole extending from the first side through the second side of the block and having a receiving section; and a linking rod extending through the through-hole of the block, with the linking rod including first and second ends, with the first end of the linking rod being manually rotatable, with the second end of the linking rod having an engaging portion, with the engaging portion engageable with the key, with the key and the linking rod being jointly movable along the axis and jointly rotatable when the engaging portion of the linking rod is engaged with the key.

2. The unlocking device as claimed in claim 1, with the hole of the movable body being eccentric to a central axis of the insertion hole.

3. The unlocking device as claimed in claim 2, with a spacing from the axis to the center of the hole in a radial direction perpendicular to the axis being larger than a radius of the hole.

4. The unlocking device as claimed in claim 1, with the through-hole including the receiving section of the block being coaxial to the hole of the movable body.

5. The unlocking device as claimed in claim 1, with the casing and the key receiving seat fixed together by a positioning member, with the movable body including a peripheral groove extending in a circumferential direction about the axis, with the peripheral groove slideably receiving the positioning member, limiting angular movement of the movable body about the axis relative to the casing and the key receiving seat.

6. The unlocking device as claimed in claim 1, further comprising: a knob fixed to the first end of the linking rod, with the engaging portion of the linking rod received in the receiving section of the block and having a maximum diameter larger than a diameter of the through-hole of the block.

7. The unlocking device as claimed in claim 6, with the block further including a third side extending between the first and second sides of the block, with the block further including a side groove extending from the third side through an inner periphery of the receiving section of the block, with the engaging portion of the linking rod including an engaging groove in communication and aligned with the side groove of the block, and with the key passing through the side groove of the block into the engaging groove of the linking rod when the movable body is moved to the first position.

8. The unlocking device as claimed in claim 7, with the key including a coupling portion engaged in the engaging groove of the linking rod when the movable body is in the first position, with the side groove of the block, the engaging groove of the linking rod, and the coupling portion of the key being arcuate and having a same radius of curvature.

9. The unlocking device as claimed in claim 1, with the key receiving hole of the key receiving seat having a diameter larger than a maximum radius of the engaging portion of the linking rod.

10. The unlocking device as claimed in claim 1, with the key receiving hole of the key receiving seat including an end having non-circular cross sections, and with the key including an insertion portion having cross sections corresponding to the non-circular cross sections of the end of the key receiving hole.

11. The unlocking device as claimed in claim 1, further comprising: an outer cover fixed around the block, with the outer cover including a hole through which the linking rod extends, and with the outer cover moving jointly with the linking rod.

* * * * *